US006525673B1

(12) United States Patent
Feldman

(10) Patent No.: US 6,525,673 B1
(45) Date of Patent: Feb. 25, 2003

(54) EXPRESSWAY CONTROL SYSTEM

(76) Inventor: Bernard Feldman, 1 Blake Ave., Watsonville, CA (US) 95076

( * ) Notice: Subject to any disclaimer, the term of this patent is extended or adjusted under 35 U.S.C. 154(b) by 246 days.

(21) Appl. No.: 09/642,193

(22) Filed: Aug. 18, 2000

Related U.S. Application Data

(60) Provisional application No. 60/151,371, filed on Aug. 30, 1999.

(51) Int. Cl.[7] ..... G08G 1/00

(52) U.S. Cl. ..... 340/928; 340/937; 340/531; 340/425.5; 340/5.2; 235/384

(58) Field of Search ..... 340/928, 937, 340/933, 539, 531, 425.5, 572.1, 10.4, 10.34, 5.2; 235/384; 250/338.3; 705/65

(56) References Cited

U.S. PATENT DOCUMENTS 3,668,684 A * 6/1972 Johnson et al. ..... 340/321
3,964,024 A 6/1976 Hutton et al. ..... 340/10.34
4,303,904 A 12/1981 Chasek ..... 235/384
5,101,200 A * 3/1992 Swett ..... 340/937
5,602,919 A 2/1997 Hurta et al. ..... 705/65
5,809,142 A * 9/1998 Hurta et al. ..... 380/24
5,819,234 A 10/1998 Slavin et al. ..... 340/10.4
5,825,007 A * 10/1998 Jesadanont ..... 235/384
5,892,226 A 4/1999 Robinson et al. ..... 250/338.3
6,064,320 A 5/2000 d'Hont et al. ..... 340/933
6,081,206 A * 6/2000 Kielland ..... 340/937
6,295,503 B1 * 9/2001 Inoue et al. ..... 701/209

OTHER PUBLICATIONS

"Transponders and Tolls", Transponder Types, "How The Transponder Works", "Tolls Explained", "Toll Technology", "Mountin The Transponder In Your Vehicle", "Toll Calculator", "407 ETR History", "Contact Us", 407 ETR Express Toll Route, http://407etr.com/h.*

* cited by examiner

*Primary Examiner*—Benjamin C. Lee

(57) ABSTRACT

A computerized Expressway Control System functions to identify the occupancy status of a vehicle such that solo driver vehicles can be automatically charged for use of the expressway. The system requires no additional equipment in the vehicle. Enforcement is readily achieved by an automated audit system.

9 Claims, No Drawings

EXPRESSWAY CONTROL SYSTEM

This application claims benefit of U.S. Provisional application No. 60/151,371 filed Aug. 30, 1999.

BACKGROUND OF THE INVENTION

Solo drivers on expressways during rush hours are a primary cause of congestion, pollution and exploding expressway construction costs. The best solution is to get these drivers into car pools and/or public transportation. The car-pool lane is expensive and has not been effective enough to constitute a significant solution. Public transportation is probably the ultimate solution but given the addiction to the private automobile, this is a way down the pike. There is a compelling need for a short term solution vis-a-vis the private automobile.

Toll lanes have been suggested as one means to solve this problem and the technology for automatically accounting for traffic on toll lanes and/or toll roads is well known and highly advanced. The problem with these systems is twofold:

1. Additional equipment is generally required in the vehicle (transponders), and
2. Expensive portions of the expressway are committed instead of use of the entire expressway.

The difficulty with the requirement for equipment in the vehicle is more than the cost of the equipment. Commitments must be made and accounts set up to provide for effective automatic charges for use of the expressway. The prior art utilizing transponders is described in part in the following patents:

1. U.S. Pat. No. 4,303,904, Dec. 1, 1981, Chasek, "Universally applicable In-motion and automatic toll Paying System Using Microwaves"
2. U.S. Pat. No. 3,964,024, Jun. 15, 1976, Hutton, et al., "Transponder for an Automatic Vehicle Identification System."
3. U.S. Pat. No. 5,602,919, Feb. 11, 1997, Hurta, et al., "Speedup for Monetary Transactions for Using a Transponder in Conjunction with a Smartcard."
4. U.S. Pat. No. 5,819,234, Oct. 6, 1998, Slavin, et al., "Toll Collection System"
5. U.S. Pat. No. 6,064,320, May 16, 2000, d'Hont, et al. "Automatic Vehicle Identification System Capable of Vehicle lane Discrimination."

A very advanced traffic management and control system on Toronto's highway E407(see http://407etr.com/home.phtml) uses license plate detection for vehicle identification in addition to transponders. However they level an additional charge for license plate detection probably because of the excess costs associated with transmitting image data instead of the more advanced prior conversion of image data by means of "Optical Character Recognition (OCR) software.

The primary problem with prior art solutions is the absence of a means of identifying the occupancy status of the subject vehicle. One way to do this is by means of infrared examination of the vehicle (see U.S. Pat. No. 5,892,226, Apr. 6, 1999, Robinson, et al., "Traffic Control Systems"). This method, although it addresses the main problem, looks complicated and expensive and is inferior to the improvement provided by my invention.

DESCRIPTION OF THE INVENTION

The principal improvement of my invention is that a means for identifying the occupancy status of the vehicle is provided without the need for or use of any additional equipment in the vehicle. At every on-ramp to the expressway a detector apparatus reads the vehicle license plate, converts the image, by means of standard OCR software, into alphanumeric data which is transmitted to a central computer database. The vehicle driver provides a signal to the detector apparatus which says in effect that the occupancy status of his vehicle qualifies for car-pool status. That might mean 2 people in the vehicle, 3, or whatever the rules of the expressway are. The detector apparatus is equipped to detect the signal. In the preferred embodiment of the invention the signal takes the form of a flashing of the vehicles lights (on to off or off to on or low beam to high beam or high beam to low beam) Other signals that do not require additional equipment include use of the horn or voice communication or, in systems that involve a vehicle stop at the apparatus, pressing a switch through an open window. The transmission of the signal means that the vehicle rides free; the absence of the signal triggers an automatic charge by the computer system. This charge, or tax, is set at a value designed to discourage use of the expressway by solo drivers. The computer may be programmed to levy the charge during rush hours only; eliminate out-of-state cars, rental cars, commercial vehicles, vehicles owned by people who cannot afford the charge, limit the charge to two trips per day, etc. Periodic billing to the vehicle's owner is the means of collecting the tax. This need not be accomplished in real time, simplifying the speed constraints on the system.

Enforcement/Auditing

Enforcement is exercised by an auditing system whereby roving vehicles and/or stationary check points are equipped with license plate detector apparatuses with instantaneous computer communication such that a vehicle which identified itself as qualifying for a free ride could be immediately detected and fined at an appropriate level to discourage this sort of cheating. The auditing personnel need not be highway patrol officers since there is no need for direct contact with the violators.

Features of the Invention

Features of this invention are:

No new expressway is required.

The detector apparatus is probably less expensive than current on-ramp metering devices.

The billing is complex but easily automated.

The system actually solves the problem.

Everybody benefits at nominal costs spread over all drivers.

I claim:

1. An expressway Control System comprising a central computer having a database, a network of expressway on-ramps along the expressway equipped with means of communication with the central computer, and equipped with a detector apparatus at each on-ramp to read the license plate of an accessing vehicle and accept a signal from the driver, such signal conveyed by the driver of the vehicle signifying that the occupancy status of the vehicle qualifies for expressway access without a charge, and such signal being conveyed without any equipment on the vehicle other than what is normally on the vehicle; the central computer and its database serve the purpose of billing the vehicle owners for expressway access and levying fines to violators detected by a network of enforcement auditors.

2. The system of claim 1 wherein the signal comprises flashing the vehicle lights: on-to-off, off-to-on, or high-beam-to-low-beam, or low-beam-to-high-beam.

3. The system of claim 1 wherein the signal comprises energizing the vehicle horn.

4. The system of claim 1 wherein the signal comprises conveying the driver's voice.

5. The system of claim 1 wherein the detector apparatus is connected to a switch or button, and the signal comprises actuating the switch or button by the driver.

6. The system of claim 1 wherein the license plate is photographed to produce image data which is converted by Optical Character Recognition (OCR) software to alphanumeric code for conveyance to the central computer with vastly reduced data content.

7. The system of claim 1 wherein the computerized billing need not be conveyed in real time.

8. The system of claim 1 wherein the network of enforcement auditors are equipped with means to read the license plate, wherein the reading means have the same or similar reading functions as the detector apparatus utilized at the on-ramps, and with immediate access to the central computer.

9. The system of claim 8, wherein the network of enforcement auditors comprises fixed auditing stations along the expressway and/or vehicles at fixed locations or vehicles roving the expressway.

* * * * *